US006938525B2

(12) United States Patent
Poole et al.

(10) Patent No.: US 6,938,525 B2
(45) Date of Patent: Sep. 6, 2005

(54) ONE HAND PIPE WRENCH

(75) Inventors: Daniel L. Poole, Phoenix, AZ (US); Robert N. Poole, Phoenix, AZ (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 09/911,242

(22) Filed: Jul. 23, 2001

(65) Prior Publication Data

US 2003/0015068 A1 Jan. 23, 2003

(51) Int. Cl.[7] ..... B25B 13/12
(52) U.S. Cl. ..... 81/151; 81/152; 81/154
(58) Field of Search ..... 81/150–152, 487, 81/134, 145, 148, 154, 126–128; 269/166–170, 6

(56) References Cited

U.S. PATENT DOCUMENTS

| | | | | |
|---|---|---|---|---|
| 218,195 | A | 8/1879 | Rhyn | |
| 465,272 | A | 12/1891 | Iverson | |
| 552,795 | A | 1/1896 | Thompson | |
| 589,046 | A | 8/1897 | Terry | |
| 599,334 | A | 2/1898 | Humphrey et al. | |
| 737,847 | A | 9/1903 | Johnson | |
| 753,837 | A | 3/1904 | Barcus | |
| 766,145 | A * | 7/1904 | Greer | 81/152 |
| 836,303 | A | 11/1906 | Christensen | |
| 836,437 | A * | 11/1906 | Cochran | 81/152 |
| 911,048 | A | 12/1909 | King | |
| 1,004,903 | A | 10/1911 | Rebagliati | |
| 1,237,122 | A | 8/1917 | Suomy | |
| 1,255,206 | A | 2/1918 | Moore | |
| 1,342,643 | A | 6/1920 | Murray | |
| 1,365,784 | A | 1/1921 | Husson | |
| 1,392,391 | A | 10/1921 | Bartz | |
| 1,412,821 | A | 4/1922 | Anderson et al. | |
| 1,420,058 | A | 6/1922 | Robins | |
| 1,529,131 | A | 3/1925 | Jenkins | |
| 2,051,969 | A | 8/1936 | Shastock | |
| 2,391,143 | A | 12/1945 | Ertner | |
| 2,459,882 | A | 1/1949 | Johnson | |
| 2,543,824 | A | 3/1951 | Beesley et al. | |
| 2,574,227 | A | 11/1951 | Sarvie | |
| 2,689,496 | A | 9/1954 | Chappell, Jr. | |
| 2,849,204 | A | 8/1958 | Petrick et al. | |
| 4,300,415 | A | 11/1981 | Saila | |
| 4,488,461 | A | 12/1984 | Hurtig | |
| 4,833,949 | A | 5/1989 | Piperkovski | |
| 4,926,722 | A | 5/1990 | Sorensen et al. | |
| 5,005,449 | A | 4/1991 | Sorensen et al. | |
| 5,009,134 | A | 4/1991 | Sorensen et al. | |
| 5,170,682 | A | 12/1992 | Sorensen et al. | |
| 5,222,420 | A | 6/1993 | Sorensen et al. | |

FOREIGN PATENT DOCUMENTS

| | | |
|---|---|---|
| FR | 2 477 457 | 9/1981 |
| GB | 1 457 414 | 12/1976 |
| GB | 1 472 278 | 5/1977 |

* cited by examiner

*Primary Examiner*—Debra S. Meislin
(74) *Attorney, Agent, or Firm*—Dennis J. Williamson; Moore and Van Allen PLLC

(57) ABSTRACT

A pipe wrench is disclosed, the pipe wrench having a uniquely handy control lever and one-way ratchet for very rapid adjustment of wrench position. The wrench also has a pivoting upper jaw that further aids a user in adjusting and tightening the wrench while using only one hand. The wrench may also be used as a hand tool, for instance for clamping an object or workpiece for performing work on the object.

21 Claims, 4 Drawing Sheets

ONE HAND PIPE WRENCH

BACKGROUND OF THE INVENTION

This invention relates to wrenches and hand tools, and more particularly, it relates to pipe wrenches and bar clamping mechanisms wherein it is desired to grip an object firmly, but wherein the tools are not specialized into so many unit sizes. Such tools are adjustable so that a number of different sizes of pipes or objects may be grasped by their jaws. Some pipe wrenches may have the ability to grasp pipes or objects as thin as ¼" or ⅛" wide or having a diameter of that dimension, on the one hand, and as thick as 5" or more on the other. One difficulty with such tools is that the adjustment typically consumes time and may require two hands to manipulate. The familiar operating nut used with pipe wrenches, in accordance with U.S. Pat. No. 737,847, may require one hand to hold the wrench and the other to operate the nut, thereby increasing or decreasing the distance between the open jaws. More importantly, adjusting the opening between the jaws of the wrench is a very time-consuming operation.

Some wrenches provide a trigger-type mechanism to advance a jaw and thus clamp or restrain a workpiece or object. In these tools, exemplified by U.S. Pat. Nos. 5,005,449, 5,009,134, and 5,222,420, a trigger-type mechanism or holder is provided. These mechanisms, however, are cumbersome and awkward, and are meant much more for holding an object in place than in manipulating the object. Furthermore, they are not designed nor are they convenient for fast, one-handed operation, since these wrenches consume time in adjusting and manipulating. By manipulating is meant the action of tightening or loosening a pipe, a pipe nut, or other rotatable object, wherein a considerable force may be applied to the adjustable pipe wrench, and for which the embodiments in the above patents are not suitable. What is needed is a wrench that is both suitable for one-handed operation and does not require a great deal of time to adjust the opening of the wrench.

BRIEF SUMMARY

One aspect of the invention is a pipe wrench that is adjustable with only one hand. The adjustable pipe wrench includes a slide bar having a gripping portion. The slide bar has an upper jaw mounted on the slide bar. A lower jaw, having a lower portion extending toward the gripping portion, is also slidably mounted on the slide bar. The lower jaw is freely movable in one direction toward the upper jaw, and is movable in the opposite direction toward the gripping portion of the slide bar. The wrench includes a brake lever, by which a user may move the lower jaw. The brake lever is pivotally mounted on a portion of the lower jaw, where it engages the slide bar. The brake lever is also spring-biased against the lower jaw, the spring urging the brake lever into engagement with the slide bar. The user may manipulate and adjust the wrench with one hand, adjusting a position of the lower jaw on the slide by opening or closing the lower jaw with a thumb of that hand. The slide bar of the adjustable wrench may also have engaging teeth, the teeth and the brake lever forming a ratcheting mechanism.

Another aspect of the invention is a method of using the adjustable mechanism as a hand tool to grasp an object. The method includes providing an object and an adjustable hand tool having a brake lever. The method also comprises gripping the object by means of the hand tool using one hand only, and then adjusting the gap between the jaws of the hand tool, using a thumb of that hand. Adjusting the gap is accomplished by using a brake lever of the hand tool, the brake lever having an operating end extending substantially the same in a longitudinal direction as a lower jaw of the hand tool, so that a single hand can conveniently grasp the tool, pressing the lever if desired, and urging the lower jaw in one direction or another with a thumb. These and other ways of using the invention will be described in the accompanying description and drawings.

DETAILED DESCRIPTION OF THE PRESENTLY PREFERRED EMBODIMENTS

Figure 1:
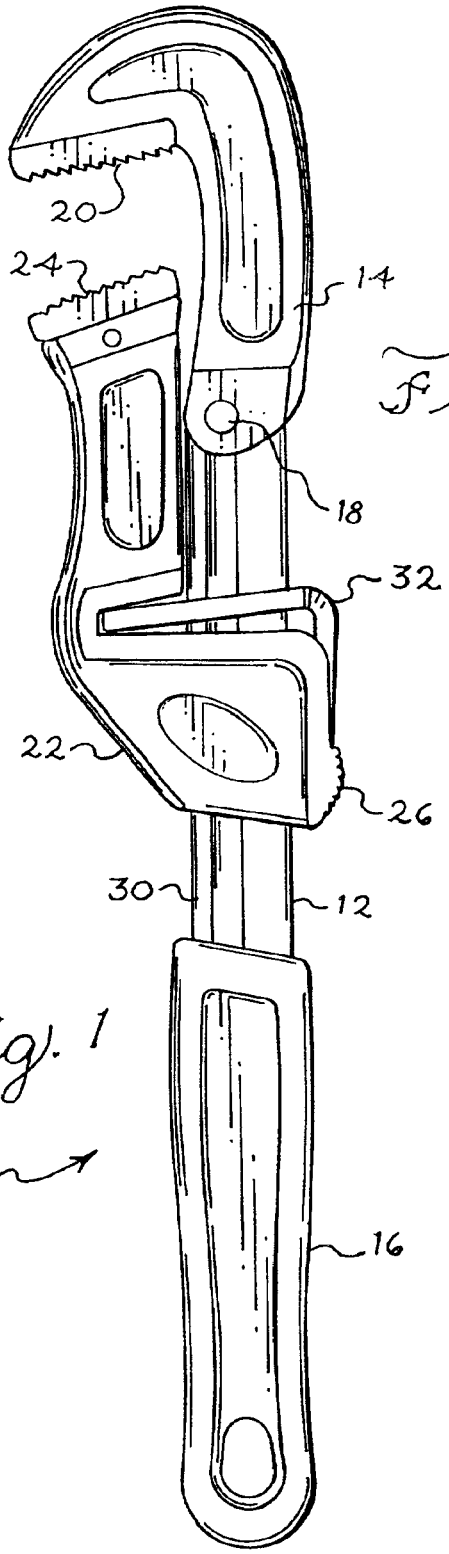
FIG. 1 is a side view of a first embodiment.

FIG. 1 is a side view of a first embodiment of a pipe wrench according to the present invention. Pipe wrench 10 has a slide bar 12 with rounded corners and a series of teeth 30 for engagement of the lower jaw 22. In a preferred embodiment, a series of teeth is cut into one face of the lower jaw, so that in combination with the brake lever below, a ratcheting mechanism is formed. Only when a user depresses the brake lever may the lower jaw be opened. The slide bar 12 has an upper portion with an upper jaw 14 and a lower portion with a gripping means 16. The upper jaw 14 is preferably pivotally connected to the slide bar by pivot pin 18. The upper jaw may also have a gripping surface 20 attached to the upper jaw. The lower jaw 22 may have a gripping surface 26, or a thumb-resting portion, attached to the lower jaw. This portion facilitates movement of the lower jaw by a thumb of an operator. The lower jaw 22 slides along the slide bar, controlled by the brake lever 32, which interfaces with teeth 30 on the slide bar 12. The brake lever is generally in the shape of a right angle, with one portion perpendicular to the slide bar, and another, operating portion generally parallel to the slide bar and extending from the perpendicular portion in the direction of the gripping surface, for most of the length of the lower jaw from that point In one embodiment, the surface of the brake lever is smooth, and the surface of the lower jaw in the region of the brake lever has a knurled or ridged surface area 26.

Figure 2:
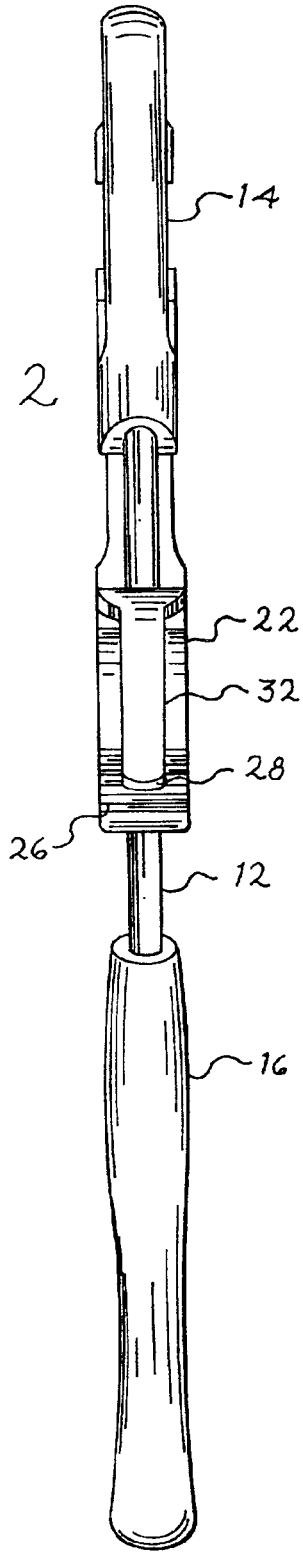
FIG. 2 is a frontal view of the embodiment.
Figure 4:
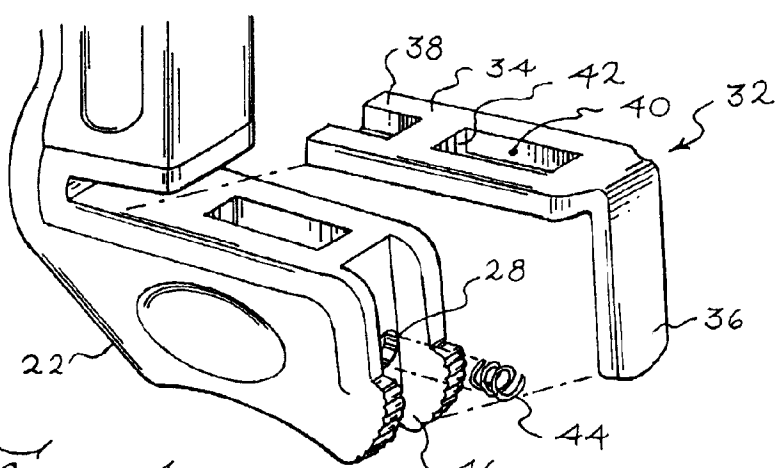
FIG. 4 is an isometric view of a portion of the lower jaw and the brake lever of the embodiment.
Figure 5:
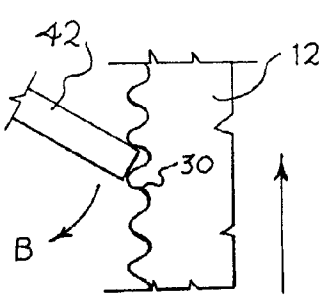
FIG. 5 is a-view-of the slide bar and mating brake lever.
Figure 3:
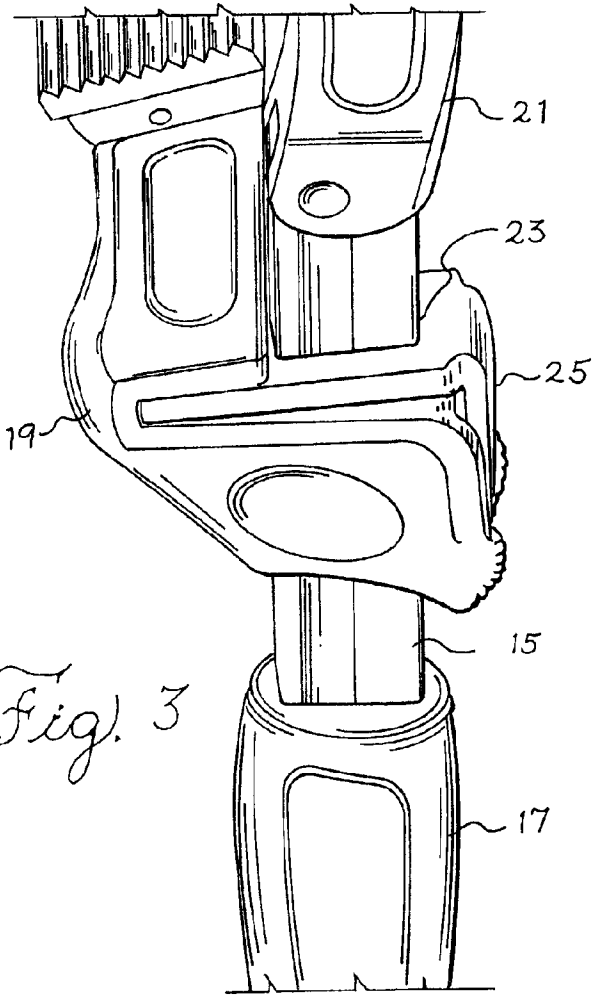
FIG. 3 is a closer isometric view of the embodiment.

FIG. 2 depicts a front view of a pipe wrench embodiment, showing the extent to which the brake lever extends downwardly toward the gripping portion of the wrench, the brake lever extending sufficiently far that a user's thumb may easily actuate the brake lever 32 via knurled portion 26 while the remainder of the user's hand remains on the gripping portion. Thus, it is possible to adjust the lower jaw using only one hand. The brake lever 32 straddles the slide bar 12 and the downwardly extending portion of the brake lever fits partially into a cavity 28 defined in the lower jaw. FIG. 3 is an enlarged isometric view of the wrench in a pipe wrench embodiment. The figure depicts a slide bar 13 that has square corners rather than round. The slide bar 15 fits into gripping portion 17, and fits through lower jaw 19, mating with upper jaw 21, all through squared-off orifices or mating features. The slide bar also fits through a square cavity 23 of the brake lever 25. The wrench may be configured with sharp corners, as shown. FIGS. 4 and 5 depict alternative embodiments of the adjustable wrench, with teeth on the slide bar and a ratcheting mechanism in FIG. 4, and without the teeth in FIG. 5. The ratcheting mechanism in this embodiment is not capable of advancing the jaw in increments, but rather is used as a series of steps or stops into which a portion-of the brake lever fits to prevent motion of the lower jaw in one direction.

FIG. 4 shows the brake lever 32 and its surrounding environment as it pertains to the lower jaw 22 only. The cavity 28 in the lower portion of the lower jaw is more easily seen in FIG. 4. The brake lever 32 has an upper portion 34 generally perpendicular to the slide bar, and a downward-extending portion 36, an operating lever, generally parallel to the slide bar and perpendicular to the upper portion of the brake lever. The upper portion has a fork 38 for engaging a portion of the lower jaw, and an orifice 40 through which the slide bar passes and which engages the slide bar on an inner surface 42 of the orifice. A spring 44 is retained in a recess 46 of the lower jaw, the spring urging the brake lever up and urging its surface 42 into contact with the slide bar 12. In one embodiment, the brake lever is stamped from 9 ga. steel sheet, about 0.15 inches thick. In other embodiments, other thicknesses may be used, desirably from 6–12 ga. (about 0.10 to about 0.20 inches thick), although other thicknesses of metal or steel may also be used.

On one end of the brake lever 32, the fork 38 is in contact with and restrained by the lower jaw 22. At the other end, the spring 44 is captured by the brake lever and urges the lever upwardly. Since the brake lever 32 is restrained at its far end by fork 38 and lower jaw 22, it can only pivot upwardly, putting notch 40 and its orifice 42 into contact with the slide bar 12. When the spring 44 is free, and the brake lever 32 is in contact with the notches or teeth 30 of the slide bar 12, the lower jaw 22 can only move oneway, that is, in a direction to close with the upper jaw. Thus, a user wanting to tighten the wrench on a pipe or an object needs merely to press with his or her thumb on the knurled or ridged surface of the lower jaw to urge the lower jaw toward the closed position, tightening the wrench. Only a thumb is needed for this quick adjustment. The lever holds the jaw in closed position, and the brake lever 32 is kept in engagement with the slide bar 12, so long as the lever is not depressed.

One embodiment of a slide bar is depicted in FIG. 5. The engaging portion 42 of the brake lever engages the slide bar 12. The teeth 30 of the slide bar engage the edge 42 of the brake lever. The brake lever is thus able to proceed only in the direction of the arrow, to close the jaws when the brake lever is engaged, because the engaging portion of the brake lever 42 is captured by friction against the slide bar. The teeth make for a firmer, better grip, as in a ratcheting mechanism, but are not strictly required, since the wrench and the gripping mechanism will work without teeth. In one embodiment, the teeth have symmetrical radii of about 0.030 inches, and also have a height, from trough to crest, of about 0.060 inches. A user has freedom in choosing teeth geometries, so long as the teeth allow the brake lever to slide closed when the brake lever is not engaged. The teeth may be formed in the desired shape, such as depicted, by a number of means, for instance by a hob or by broaching the slide bar. For better wear over time, the mating surfaces of both the slide bar and the brake lever are preferably made of case-hardened steel.

Figure 6:
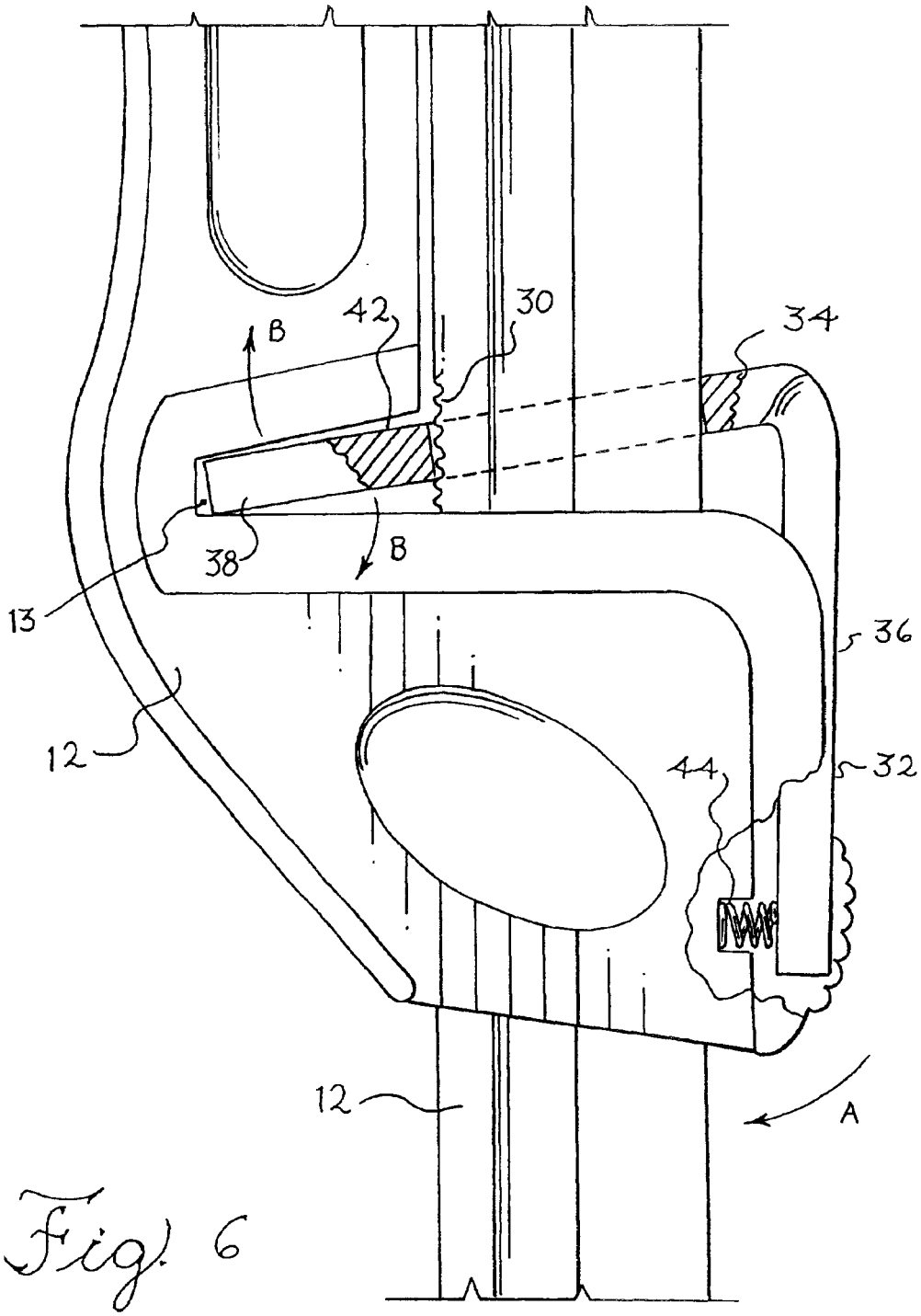
FIG. 6 is a diagrammatic view of the operation of the brake lever.

FIG. 6 depicts the operation of the brake lever 32 in relation to the slide 12 and the teeth 30. The normal, resting position of the tool is that the lever portion 36 of the brake lever is not depressed, and is kept in this state by a spring 44, urging the lever away from the slide 12, and keeping the engaging portion 42 of the upper portion 34 engaged with the teeth of the slide bar 12. The brake lever 32 is also restrained at end 42 where it rests in slot 13 of lower jaw 12. The pivoting movement of the brake lever 42 is restrained by the upper and lower surfaces of the slot 13 of the lower jaw 12. When a user depresses the lever 36 in the direction of arrow A, the lever pivots but is restrained at its far end 38. It therefore pivots about the intersection of end 38 in slot 13, causing engaging portion 42 to swing down and away from the teeth 30, in the direction of arrow B. As can be more clearly seen from the pivoting arrow B in FIG. 5, removing the brake lever from the slide bar 12 and teeth 30 allows the user to open the jaws of the adjustable wrench. When the user releases the lever, the spring then urges the lever and the engaging portion back to their resting positions. The direction of movement of the various parts is thus reversed from the direction of the arrows shown.

If a user wishes to open the jaws of the wrench, the user disengages the brake lever from the slide bar. The user preferably does this by depressing the brake lever in a direction to compress the spring. The user does this with a thumb, and at the same time, uses the thumb to push the lower jaw either to a more open or to a more closed position. Note that the retractable, pivotable upper jaw may also release from a gripping position without adjusting the opening of the lower jaw via the lever and slide bar. A user may accomplish these actions with the same hand used to hold the wrench by its gripping surface 16. When the wrench has the correct adjustment, the user releases the brake lever, thus engaging the slide bar once again. Since the lower jaw is restrained from further opening, the wrench holds tightly to whatever the user has secured it, such as a pipe or an object. These actions are accomplished very quickly with the embodiments disclosed herein.

Figure 7:
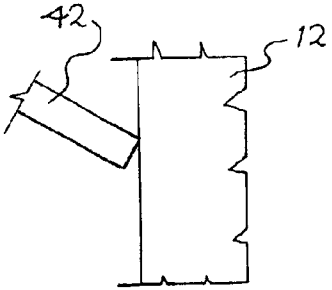
FIG. 7 is an alternate embodiment of a slide bar and brake lever.

FIG. 7 discloses another embodiment of an adjustable wrench, in which the teeth of the slide bar 12 are replaced by a smooth surface. The engaging portion 42 of the brake lever, urged by spring 44, continues to engage the slide bar. The brake lever is held in place by friction between the engaging portion and the slide bar. Thus, the teeth disclosed above are not strictly necessary for preventing opening of the jaws of the wrench.

Figure 8:
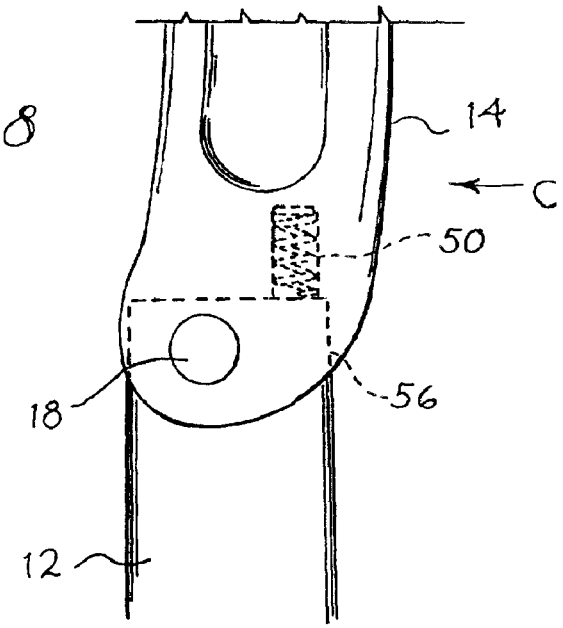
FIG. 8 is a view of the upper jaw portion of a pipe wrench embodiment.

FIG. 8 depicts a further embodiment using an upper jaw 14 that is pivotable about the assembly pin 18. A spring 50 is captured between the slide bar 12 and the upper jaw 14, allowing the upper jaw to pivot away from the slide bar at a lower end of the jaw, the end having the pivot point 18. The spring 50 urges the upper, pivotable jaw 14 in the direction of arrow C. In that direction, the upper jaw 14 and its gripping surface 20, if provided, are somewhat closer to the lower jaw 22 and its gripping surface 24, if provided. The jaws are moved slightly farther apart by a user pivoting the upper jaw about an object, such as a pipe or a pipe nut. When the object is released, the spring or washer urges the upper jaw to return to its rest position, in a movement opposite to the direction of arrow C. This pivotable upper jaw, allowing the jaws to open wider, may be used to increase the utility of embodiments of the wrench.

A user may grasp a pipe in order to tighten first the wrench about the pipe and then to tighten the pipe, for instance a joint between two pipes. With one hand, the user places the pipe wrench about the pipe and disengages the brake lever with a thumb of that hand. Using that same thumb, the user opens or closes the jaws as needed, preferably using a knurled or roughened surface of the lower jaw, and the final movement of the thumb will be to close the jaws. The user may then use his hand or arm to rotate the wrench, engaging or not engaging the pivoting spring in the slide bar and using the pivoting motion of the upper jaw to more firmly grasp the desired object. All these motions are accomplished very quickly with the embodiments described herein.

Figure 9:
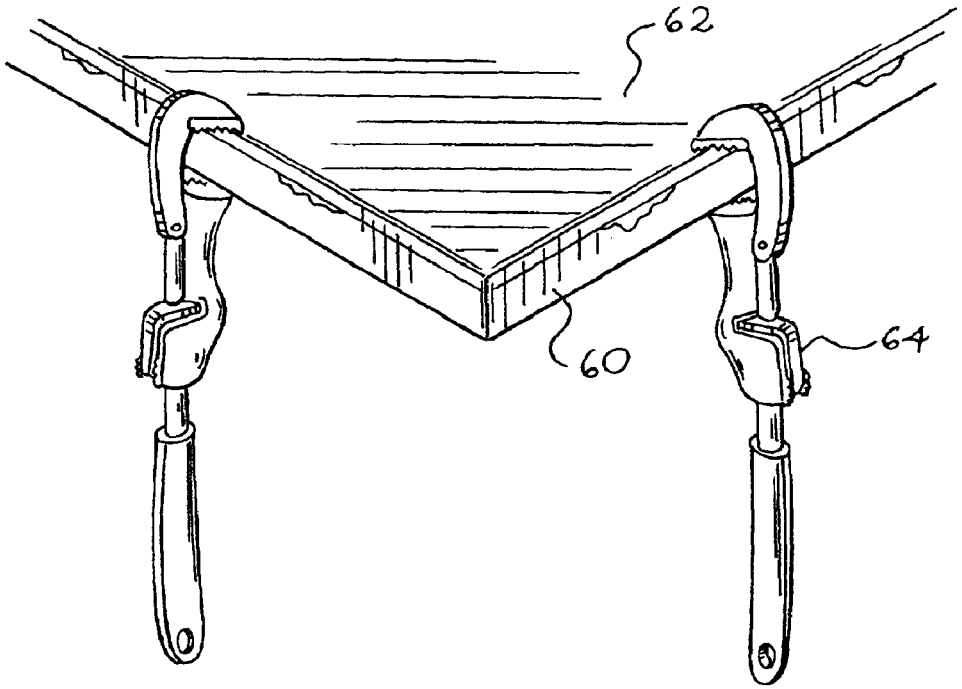
FIG. 9 is depicts an alternate use of an embodiment.

Embodiments have thus far been described in terms of a pipe wrench and tightening pipes or joints of pipes using the pipe wrench. Embodiments may also be used for purposes other than pipe wrenches. Thus, a workpiece may be grasped or affixed in place to a surface by means of a hand tool incorporating the features listed above. That is, a hand tool having a slide bar and a brake lever, an upper jaw, a lower jaw and a brake lever, may be used as a clamp to hold objects. FIG. 9 depicts hand tools used to clamp an object to a surface. Workpieces 60 and 62 are held together by several clamps 64 according to the present invention, for instance, for gluing the pieces together.

Embodiments make use of a variety of surfaces and textures for better efficiency in using the tool. The slide bar is preferably ground or polished to every smooth state, preferably 16 microinches AA or better. This will insure smooth sliding of the lower jaw up and down the slide bar. Of course, the mating surface on the lower jaw should also be ground or polished to the same extent. The gripping surface of the clamp should be somewhat rougher, so that it is easily grasped and held without slipperiness. In one embodiment, the gripping surface has a roughness of at least 250 microinches, or rougher. In another embodiment, the wrench or hand tool upper and lower jaws are fitted with gripping inserts, the inserts having ridges and troughs separated by 0.050 inches, 0.060 inches, or more, so that a pipe or workpiece may be easily gripped.

While this invention has been shown and described in connection with the preferred embodiments, it is apparent that certain changes and modifications, in addition to those mentioned above, may be made from the basic features of this invention. The clamping mechanism may be used in many different types of tools for grasping, holding and manipulating. It may also be used in a great variety of other applications without departing from the spirit of the invention.

What is claimed is:

1. An adjustable pipe wrench, comprising:

a slide bar having a gripping portion;

an upper jaw mounted pivotally to the slide bar and a spring mounted between the upper jaw and the slide bar;

a lower jaw, slidably mounted on the slide bar, said lower jaw having a lower portion receiving the slide bar and an upper portion not intersecting with and apart from the slide bar, and supported only by the lower portion; said lower portion having a length in a direction along the slide bar; and a brake lever, pivotally mounted between the upper and lower portions of the lower jaw and spring-biased against said lower jaw wherein a portion of the brake lever extends along the lower portion for substantially said length, and wherein a user may adjust a position of the lower jaw on the slide bar by actuating said brake lever and moving said lower jaw relative to said slide bar.

2. The wrench of claim 1, wherein the brake lever has an operation portion angled so it extends generally parallel to the slide bar.

3. The wrench of claim 1, wherein the lower jaw has a thumb-resting portion to facilitate movement by a thumb of an operator.

4. The wrench of claim 1, wherein the brake lever has an orifice for slidably mounting around the slide bar.

5. The wrench of claim 1, wherein the slide bar further comprises a ratcheting mechanism, said ratcheting mechanism including a surface of the brake lever and teeth on a surface of the slide bar.

6. The wrench of claim 5, wherein the ratcheting mechanism advances said lower jaw toward said upper jaw in increments.

7. The wrench of claim 1, further comprising gripping surfaces on the upper jaw and lower jaw.

8. An adjustable hand clamp, comprising:

a slide bar having a gripping portion;

an upper jaw mounted to the slide bar;

a lower jaw, slidably mounted on the slide bar, said lower jaw having a first portion on only a first side of the slide bar extending toward the upper jaw and a second portion on a first side and a second side of the slide bar extending in an opposite direction toward the gripping portion, said second portion having a gripping surface opposite said first portion; and a brake lever, pivotally mounted on the lower jaw and spring-biased against said lower jaw, wherein a portion of the brake lever extends to said gripping surface such that a thumb of a user can contact both the gripping surface and said portion of the brake lever when in a braked position at the same time, and wherein a user adjusts a position of the lower jaw on the slide, by depressing said brake lever and repositioning the lower jaw with the thumb.

9. The clamp of claim 8, wherein the brake lever has an orifice for slidably mounting around the slide bar.

10. The clamp of claim 8, wherein the slide bar further comprises a ratcheting mechanism, said ratcheting mechanism including a surface of the brake lever and teeth on a surface of the slide bar.

11. The clamp of claim 10, wherein the ratcheting mechanism advances said lower jaw toward said upper jaw in increments.

12. The clamp of claim 8, wherein said lower portion defines a recess for receiving said portion of the lever.

13. The clamp of claim 8, wherein the lower jaw is subject to motion toward the upper jaw when the lever is engaged, and is subject to motion to and from the upper jaw when the brake lever is disengaged.

14. A method of grasping an object with one hand using an adjustable hand tool having a brake lever, the method comprising:

providing the object and the hand tool, the hand tool comprising a slide bar, and a lower jaw and a pivotable upper jaw mounted on the slide bar gripping the hand tool with one hand;

using the lower jaw and the pivotable upper jaw of the hand tool, wherein the lower jaw has a lower portion on a first side and a second side of the slide bar, the lower portion extending toward a gripping portion of the hand tool and an upper portion not intersecting with the slide bar and supported only by the lower portion, the upper portion extending toward the pivotable jaw, said second portion having a gripping surface opposite said first portion and the brake lever of the hand tool is pivotally mounted on a portion of the lower jaw, and wherein a portion of the brake lever extends to said gripping surface such that a thumb of a user can contact both the griping surface and said portion of the brake lever at the same time;

adjusting a gap between the upper jaw and the lower jaw with the same hand by depressing said brake lever with the thumb and simultaneously applying a force to said gripping surface with said thumb, and grasping the object between the jaws.

15. The method of claim 14, further comprising disengaging a brake lever of the hand tool, the brake lever extending substantially the same longitudinally as a lower jaw of the hand tool; and engaging the brake lever of the hand tool.

16. The method of claim 14, further comprising tightening a grasp on the object, urging the pivotable upper jaw and a moving lower jaw to grasp the object more tightly, wherein the hand partially rotates the hand tool about the object and presses the lower jaw toward the upper jaw.

17. An adjustable pipe wrench, comprising:

a single slide bar having a gripping portion;

an upper jaw mounted to the slide bar;

a lower jaw, slidably mounted on the slide bar, said lower jaw having a first portion extending toward the upper jaw, wherein said first portion does not intersect the slide bar, and a second portion extending in an opposite direction toward the gripping portion, said second portion defining an orifice for receiving said single slide bar and a recess disposed along a gripping surface; and a brake lever, pivotally mounted between the first and second portions of the lower jaw and spring-biased on the second portion of the lower jaw, wherein a portion of the brake lever extends along said second portion of the lower jaw and into said recess, and wherein the brake lever and the slide bar form a bar-engaging mechanism, and a user may open the jaws with a thumb, disengaging the brake lever from the slide bar and urging the lower jaw away from the upper jaw.

18. The adjustable wrench of claim 17, wherein the user closes the jaws of the wrench by pushing the lower jaw toward the upper jaw with the thumb.

19. The adjustable wrench of claim 17, wherein the bar-engaging mechanism further comprises teeth on a surface of the slide bar, wherein the brake lever engages the teeth and prevents opening of the jaws.

20. The adjustable wrench of claim 17, further comprising a spring mounted between the upper jaw and the slide bar.

21. An adjustable pipe wrench, comprising:

a slide bar having a gripping portion;

a lower jaw slidably mounted on the slide bar, said lower jaw having a lower portion extending toward the gripping portion and an upper portion on only one side of the slide bar, an upper jaw having a gripping surface disposed on said one side of the slide bar, said upper jaw mounted pivotally to the slide bar and having a spring captured between said upper jaw and said slide bar, said spring biasing said upper jaw so that the gripping surface of said upper jaw is biased toward said lower jaw; and a brake lever, pivotally mounted on a portion of the lower jaw and spring-biased against said lower jaw wherein a portion of the brake lever extends such that the lower portion is between the brake lever and the slide bar, and wherein a user may adjust a position of the lower jaw on the slide by actuating said brake lever and moving said lower jaw relative to said slide bar.

* * * * *